US007586246B2

(12) United States Patent
Okamoto

(10) Patent No.: US 7,586,246 B2
(45) Date of Patent: Sep. 8, 2009

(54) SPARK PLUG DESIGNED TO ENSURE HIGH STRENGTH OF ELECTRODE JOINT AND PRODUCTION METHOD THEREOF

(75) Inventor: Shigenori Okamoto, Hekinan (JP)

(73) Assignee: DENSO CORPORATION, Kariya (JP)

( * ) Notice: Subject to any disclaimer, the term of this patent is extended or adjusted under 35 U.S.C. 154(b) by 451 days.

(21) Appl. No.: 11/049,302

(22) Filed: Feb. 3, 2005

(65) Prior Publication Data

US 2005/0174025 A1 Aug. 11, 2005

(30) Foreign Application Priority Data

Feb. 6, 2004 (JP) ..... 2004-030907
Nov. 25, 2004 (JP) ..... 2004-340406

(51) Int. Cl.
*H01T 13/32* (2006.01)

(52) U.S. Cl. ..... 313/141; 313/144; 313/143

(58) Field of Classification Search ..... 313/118–145
See application file for complete search history.

(56) References Cited

U.S. PATENT DOCUMENTS 6,307,307 B1 10/2001 Kanao
6,373,172 B1 4/2002 Kanao et al.
6,412,465 B1 * 7/2002 Lykowski et al. ..... 313/141
6,586,865 B1 * 7/2003 Tamai ..... 313/141
2002/0021066 A1 * 2/2002 Kanao ..... 313/141
2002/0063504 A1 5/2002 Hori

FOREIGN PATENT DOCUMENTS

JP 04-104491 4/1992
JP 2001-210447 8/2001
JP 2002-222686 8/2002

OTHER PUBLICATIONS

Japanese Official Action dated Apr. 14, 2009, issued in counterpart Japanese Application No. 2004-340406 with English Translation.

* cited by examiner

*Primary Examiner*—Mariceli Santiago
*Assistant Examiner*—Christopher M Raabe
(74) *Attorney, Agent, or Firm*—Nixon & Vanderhye, PC

(57) ABSTRACT

An improved structure of a spark plug is provided to ensure a high strength of joint between a ground electrode and a metal shell. The ground electrode is resistance-welded to the metal shell so that it is embedded partially in an end surface of the metal shell to create a weld interface extending from the end surface to an inner periphery of the metal shell, thus resulting in an increased size of the weld interface to increase the joint strength. The resistance welding keeps the temperature of a weld between the ground electrode and the metal shell at a lower level during welding as compared with laser welding, thus minimizing solidification cracking in the weld.

11 Claims, 9 Drawing Sheets

BEFORE WELDING

BEFORE WELDING

SPARK PLUG DESIGNED TO ENSURE HIGH STRENGTH OF ELECTRODE JOINT AND PRODUCTION METHOD THEREOF

CROSS REFERENCE TO RELATED DOCUMENT

The present application claims the benefit of Japanese Patent Application Nos. 2004-30907 and 2004-340406 filed on Feb. 6, 2004 and Nov. 25, 2004, respectively, the contents of which are incorporated herein by reference.

BACKGROUND OF THE INVENTION

1. Technical Field of the Invention

The present invention relates generally to a spark plug which produces a series of sparks to ignite an air-fuel mixture and a production method thereof, and more particularly to such a spark plug designed to ensure a high strength of joint between a ground electrode and a metal shell and a production method thereof.

2. Background Art

US 2002/0063504 A1 (Japanese Patent First Publication No. 2002-222686) discloses a spark plug which has an Ir (iridium) alloy-made ground electrode joined directly to an end surface of a metal shell by laser welding. U.S. Pat. No. 6,307,307 B1 and U.S. Pat. No. 6,373,172 B1 (Japanese Patent First Publication No. 2001-210447) propose spark plugs which include an Ni base alloy-made support joined to a metal shell and an Ir alloy-made ground electrode joined to the support by laser welding. The ground electrode contains 50 Wt % or more of Ir and is embedded in the support.

When the ground electrode is joined to the metal shell using typical laser welding techniques, a weld area between them is usually small, which could result in a lack of the strength of the joint between the ground electrode and the metal shell. Similarly, the weld between the metal shell and the Ni base alloy-made support may lack the mechanical strength because of restriction on a weld area. Usually, the laser welding results in a considerable rise in temperature of a weld during exposure to laser beams. After the laser exposure, the weld is cooled rapidly, thus increasing the possibility of solidification cracking thereof, which results in a lack of the strength of the joint between the ground electrode and the metal shell.

In recent years, modern automotive vehicles have been required to meet high power, low fuel consumption, and low exhaust emissions requirements, thus resulting in an increase in temperature of burning atmosphere in the engine. Therefore, when the weld between the metal shell and the ground electrode has already experienced the solidification cracking, and the ground electrode which is usually subjected to the most intense heat in the combustion chamber of the engine rises in temperature thereof greatly, it may cause the weld to be cracked completely, thus resulting in separation of the ground electrode from the metal shell.

SUMMARY OF THE INVENTION

It is therefore a principal object of the invention to avoid the disadvantages of the prior art.

It is another object of the invention to provide a spark plug designed to ensure a higher strength of joint between a ground electrode and a metal shell.

According to one aspect of the invention, there is provided a spark plug which works to produce a sequence of sparks to ignite an air-fuel mixture and which is so designed as to provide a higher strength of joint between a ground electrode and a metal shell. The spark plug comprises: (a) a hollow cylindrical metal shell; (b) a center electrode retained in the metal shell to be insulated from the metal shell; and (c) a ground electrode having a portion facing a tip of the center electrode through a spark gap. The ground electrode is joined to the metal shell through a weld. The weld ranges from an end surface to an inner peripheral surface of the metal shell. This results in an increased weld interface between the ground electrode and the metal shell, thereby enhancing the strength of the joint between the ground electrode and the metal shell.

In the preferred mode of the invention, the ground electrode is jointed to the metal shell by resistance welding. The use of the resistance welding facilitates ease of welding the ground electrode to the metal shell.

The shell may have an extension extending from the end surface of the metal shell in a longitudinal direction of the metal shell. The ground electrode is welded to the extension. This structure permits the length of the ground electrode to be reduced by an amount equivalent to the height of the extension, thereby enhancing the heat disappearance from the ground electrode. Additionally, the extension permits the ground electrode to extend inwardly of the metal shell and perpendicular to the longitudinal center line of the metal shell. This allows the ground electrode to be minimized in length thereof, thereby enhancing the heat disappearance from the ground electrode further.

The ground electrode may be made of a plate member which extends straight from the weld to the metal shell toward the longitudinal center line of the metal shell. Use of such a plate member results in a decreased length of the ground electrode exposed to a combustion chamber of the engine as compared with a conventional L-shaped ground electrode, thus leading to a decreased temperature of the ground electrode during running of the engine.

The tip of the center electrode may project outside the end surface of the metal shell in a longitudinal direction of the metal shell, thereby enhancing the spread of the flame kernel in the combustion chamber of the engine to improve the ignitability of an air-fuel mixture. The extension may extend outside the tip of the center electrode in the longitudinal direction of the metal shell, thereby allowing the ground electrode to be decreased in length to enhance the heat disappearance from the ground electrode.

The weld is formed by melting the ground electrode and the end surface of the metal shell and sinking a portion of the end surface of the metal shell into the ground electrode in the longitudinal direction of the metal shell. A sinking depth of the metal shell is preferably 0.4 mm or more, thereby ensuring the strength of the joint between the ground electrode and the metal shell sufficient for practical use. The sinking depth is preferably 1.0 mm or less, thereby decreasing weld burrs to a practical allowable size.

A ratio of the sinking depth of the metal shell to a thickness of a major body of the ground electrode is within a range of 0.2 to 0.7, thereby ensuring a desired mechanical strength of the ground electrode without sacrificing the strength of the joint between the ground electrode and the metal shell.

The extension may have a length which extends in a circumferential direction of the end surface of the metal shell and is greater than a width of the ground electrode, thereby ensuring a weld interface between the ground electrode and the metal shell sufficient for achieving the heat disappearance from the ground electrode without sacrificing the thermal resistance of the ground electrode.

The length of the extension preferably ranges cover one-second or less of the circumference of the end surface of the metal shell, thereby minimizing obstruction of the extension to the spread of the flame kernel in the combustion chamber of the engine.

The ground electrode may contain 50 Wt % or more of one of Ni and Fe.

According to the second aspect of the invention, there is provided a production method of a spark plug composing the steps of: (a) preparing a hollow cylindrical metal shell which has an inner shoulder formed therein and an end surface with an opening; (b) preparing a cylindrical first electrode and a second electrode, the second electrode being contoured to an inner shape of the metal shell and including an electrode contact and a stopper; (c) disposing the second electrode within the metal shell with the electrode contact abutting the inner shoulder of the metal shell and the stopper exposed to the opening of the end surface of the metal shell; (d) placing a ground electrode on the end surface of the metal shell; and (e) moving the first electrode to press the ground electrode against the end surface of the metal shell until the ground electrode abuts the stopper of the second electrode while supplying an electrical current between the first and second electrodes to resistance-weld the ground electrode to the end of the metal shell. Specifically, the welding of the ground electrode to the metal shell is achieved while the ground electrode is being nipped firmly between the first electrode and an end surface of the stopper of the second electrode. The location and orientation of the ground electrode relative to the metal shell is, thus, determined by the end surface of the stopper, thus ensuring a desired degree of parallelization of a discharging surface of the ground electrode 40 to the end surface of the metal shell. This eliminates the need for adjusting the orientation of the ground electrode after being welded to the metal shell and assures a high strength of joint between the ground electrode and the metal shell.

In the preferred mode of the invention, the second electrode may be made of a cylindrical member having the electrode contact and the stopper formed integrally with each other. This facilitates the ease of insertion of the second electrode into the metal shell.

Each of the first and second electrodes may be made of a copper alloy.

The ground electrode may be resistance-welded to the end of the metal shell under a constant pressure.

The metal shell may have a protrusion formed on an inner edge portion of the end surface. In this case, the ground electrode is placed on the protrusion on the end surface of the metal shell. The electrical current applied between the first and second electrodes is first concentrated on the protrusion so that the protrusion is softened or melted to facilitate welding of the ground electrode to the metal shell.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 4(*b*) is a partially sectional view of FIG. 4(*a*);

FIG. 18(*b*) is a partially longitudinal sectional view of FIG. 18(*a*).

DESCRIPTION OF THE PREFERRED EMBODIMENTS

Figure 1:
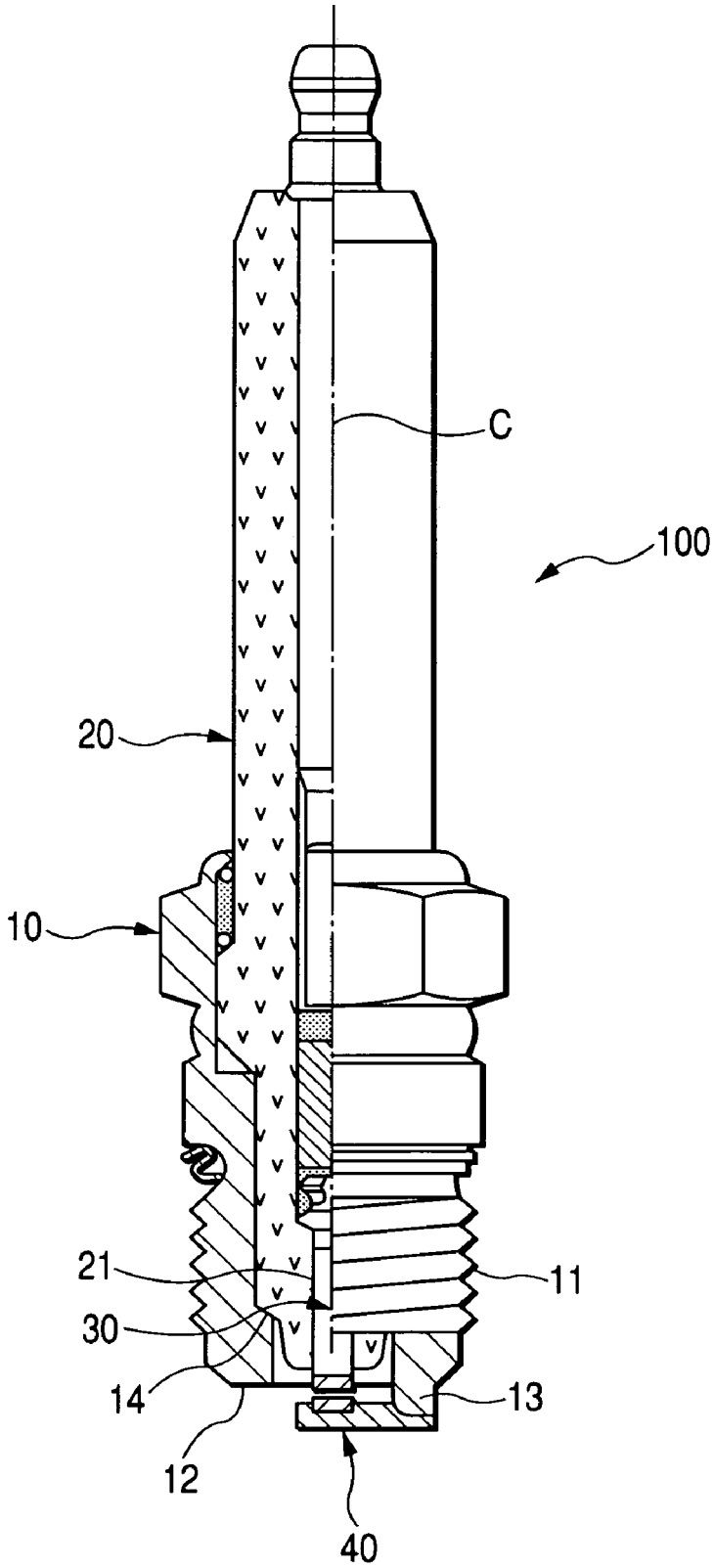
FIG. 1 is a partially longitudinal sectional view which shows a spark plug according to the first embodiment of the invention.

Referring to the drawings, wherein like reference numbers refer to like parts in several views, particularly to FIG. 1, there is shown a spark plug 100 which may be used ignite an air-fuel mixture in internal combustion engines.

The spark plug 100 includes a cylindrical metal housing or shell 10, a porcelain insulator 20, a center electrode 30, and a ground electrode 40. The metal shell 10 is made of, for example, a carbon steel and has cut therein a thread 11 for mounting the spark plug 100 in a cylinder block of the engine (not shown). The metal shell 10 has an end surface 12 which will be referred to as a reference surface below) and an extension 13 extending form the reference surface 12 in parallel to a longitudinal center line C (i.e., an axis) of the metal shell 12.

The porcelain insulator 20 made of an alumina ceramic ($Al_2O_3$) is retained within the metal shell 10. The porcelain insulator 20 has formed therein an axial bore 21 within which the center electrode 30 is retained to be electrically insulated from the metal shell 10. The center electrode 30 has a tip portion which is exposed outside the insulator porcelain 20 and protrudes outside the reference surface 12 of the metal shell 10 in the longitudinal direction of the metal shell 10. The extension 13 of the metal shell 10 protrudes from the tip end of the center electrode 30 in the longitudinal direction of the metal shell 10.

Figure 2:
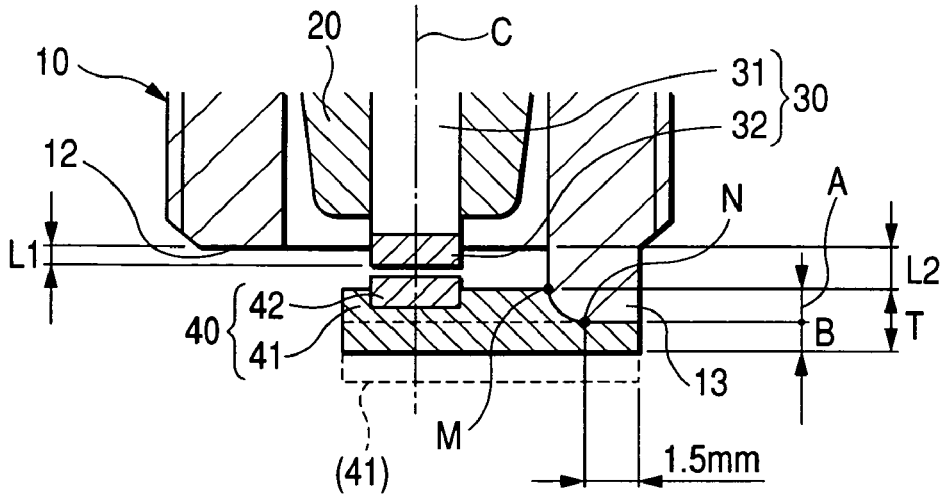
FIG. 2 is a partially sectional view which shows a weld between a ground electrode and a metal shell of the spark plug of FIG. 1.

The center electrode 30, as shown in FIG. 2, consists of a body 31 and an Ir alloy chip 32. The body 31 is made of a cylindrical member which consists of a core portion made of a metallic material such as Cu having a higher thermal conductivity and an external portion made of a metallic material such as an Ni-based alloy having higher thermal and corrosion resistances. The Ir alloy chip 32 is of a disc shape and joined to an end of the body 31 by laser welding or arc welding.

Figure 3:
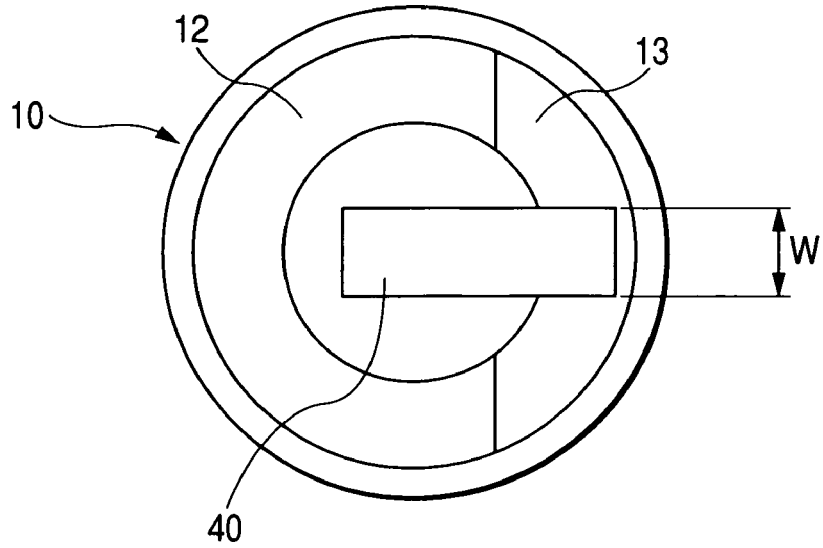
FIG. 3 is a top view of FIG. 2.

The ground electrode 40, as shown in FIGS. 2 and 3, includes a plate body 41 made of an Ni-based alloy such as Inconel (trade mark) and a chip 42 joined to the plate body 41 by laser welding or arc welding. The chip 42 is made of a Pt alloy plate. The plate body 41 is joined to the extension 13 of the metal shell 10 by resistance welding and extends straight from the extension 13 so as to traverse perpendicular to the longitudinal center line C. The chip 42 faces the chip 32 of the center electrode 42 through the spark gap.

The joining of the plate body 41 of the ground electrode 40 to the extension 13 of the metal shell 10 is, as clearly shown in FIG. 2, achieved by placing the plate body 41, as indicated by a broken line, on the end of the extension 13 and electrifying the plate body 41 under pressure to melt the surface of the plate body 41 in contact with the extension 13, thereby sinking the end of the extension 13 into the plate body 41 to a depth, as indicated by a solid line, to form a joint of the plate body 41 with the extension 13 which continues from the end to a portion of an inner periphery of the extension 13.

The distance L1 between the tip of the chip 32 of the center electrode 30 and the reference surface 12 of the metal shell 10 in the longitudinal direction of the metal shell 10 is 0.5 mm. The distance L2 between an interface M of the ground electrode 40 with the extension 13 and the reference surface 12 in the longitudinal direction of the metal shell 10 is 1.0 mm.

The joining of the ground electrode 40 to the metal shell 10 is, as described above, achieved by melting the ground electrode 40 to embed a portion of the extension 13 into the ground electrode 40, thus improving the strength of the joint of the ground electrode 40 with the metal shell 10. The joint ranges to the inner periphery of the extension 113 as well as the end thereof, thus resulting in an increased interface of the joint with the extension 13, which ensures a higher degree of the strength of the joint.

Usually, the resistance welding is lower in temperature of a weld zone than the laser welding, so that the weld zone is cooled slowly and withstands solidification cracking. Specifically, the resistance welding is effective to enhance the reliability of strength of the joint of the ground electrode 40 with the metal shell 10.

The welding of the ground electrode 40 to the extension 13 of the metal shell 10 allows the volume of the ground electrode 40 to be decreased by an amount corresponding to the length of the extension 13, thereby enhancing the heat disappearance from the ground electrode 40. The formation of the extension 13 on the metal shell 10 enables the ground electrode 40 to extend straight from the joint with the extension 13 perpendicular to the longitudinal center line C of the metal shell 10. This permits the length of the ground electrode 40 to be minimized as compared with when an L-shaped ground electrode is used, thereby increasing the heat disappearance from the ground electrode 40 further.

The tip portion of the center electrode 30, as described above, protrudes from the reference surface 12 of the metal shell 10, thereby facilitating ease of expansion of the flame kernel within the combustion chamber of the engine and improving the ignitability of an air-fuel mixture. The extension 13 of the metal shell 10 protrudes from the tip of the center electrode 30, thereby allowing the ground electrode 40 to be shortened in length to increase the heat disappearance from the ground electrode 40.

Figure 4A:
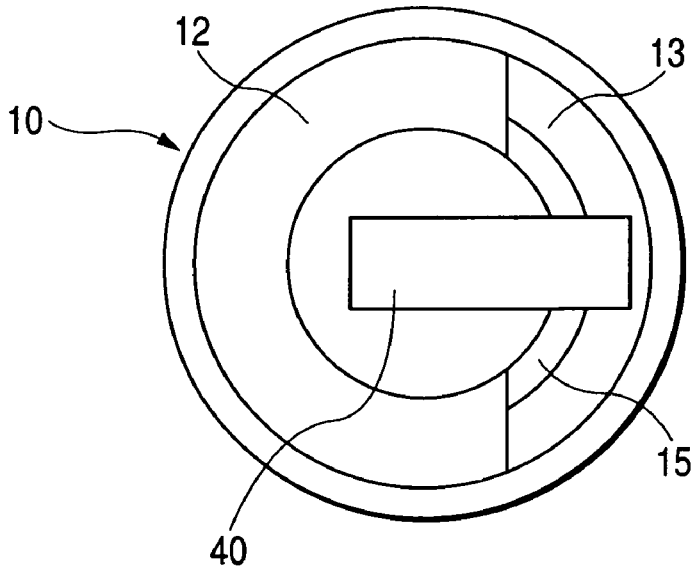
FIG. 4(*a*) is a top view which shows a spark plug before a ground electrode is welded to a metal shell.
Figure 4B:
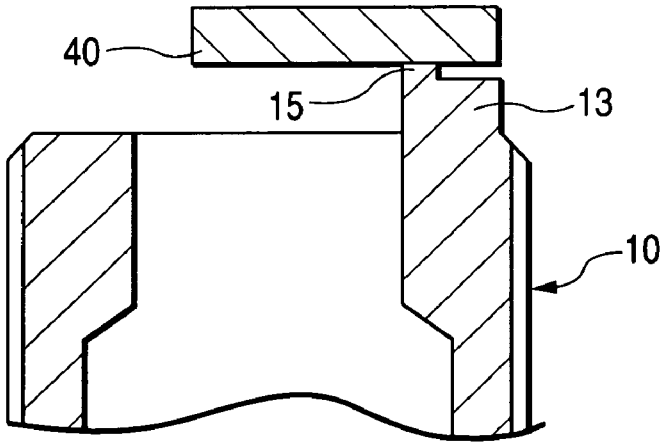

The resistance welding of the ground electrode 40 to the metal shell 10 of the spark plug 100 will be described below in detail. FIG. 4(*a*) is a top view of the metal shell 10 before the ground electrode 40 is welded to the metal shell 10. FIG. 4(*b*) is a partially sectional view of FIG. 4(*a*). The extension 13, as clearly shown in FIG. 4(*b*), has a step or protrusion formed on the tip end thereof. FIG. 4(*b*) emits the chip 42 to be joined to the ground electrode 40 for the brevity of illustration.

The metal shell 10, as described above, has the extension 13 which is, as can be seen from FIG. 4(*a*), of an arc-shape. The extension 13 has the protrusion 15 which is of an arc-shape and formed on an inner edge of the upper end thereof.

Figure 5B:
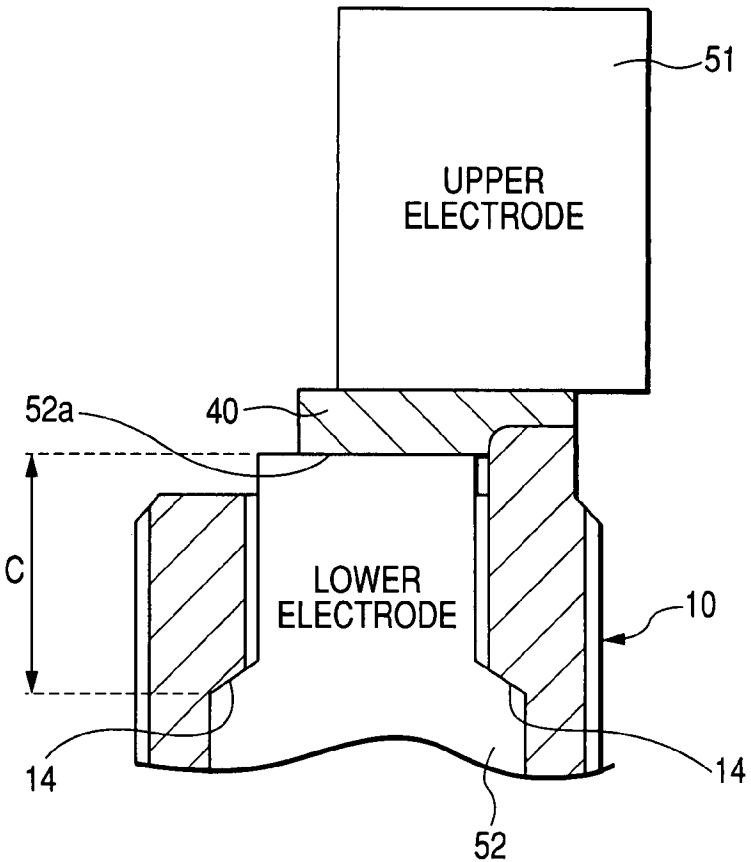
FIGS. 5(*a*) and 5(*b*) are partially sectional views which show steps of welding a ground electrode to a metal shell using resistance welding techniques.
Figure 5A:
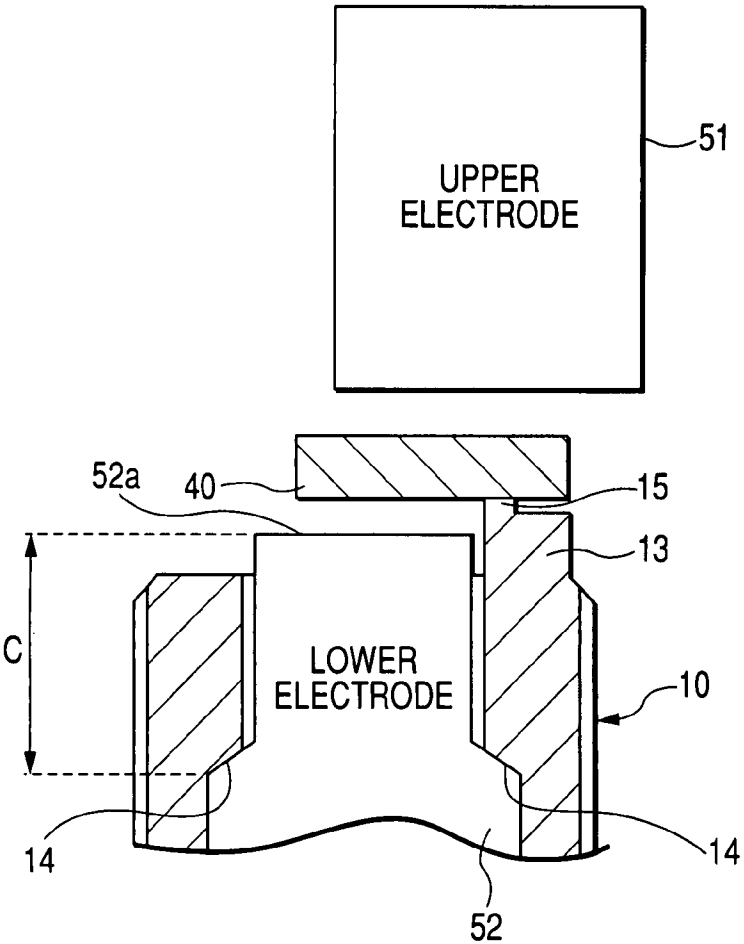

FIGS. 5(*a*) and 5(*b*) are partially sectional views which illustrate the ground electrode 40 before and after welded to the metal shell 10, respectively.

First, upper and lower electrodes 51 and 52 are prepared. The upper electrode 51 is made of, for example, a cylindrical electrode and used to press the ground electrode 40 against the extension 13 of the metal shell 10. The lower electrode 52 is contoured to conform with the contour of an inner wall of the metal shell 10 and disposed inside the metal shell 10 with a tip portion protruding outside the reference surface 12. Specifically, the lower electrode 52 includes an electrode contact which is to be placed in abutment with an inner shoulder 14 of the metal shell 10 and a stopper extending upward, as viewed in the drawing, from the electrode contact. The stopper is formed integrally with the electrode contact and placed so as to protrude from the reference surface 12 of the metal shell 10. The upper and lower electrodes 51 and 52 are made of, for example, a copper alloy such as a copper-chromium alloy.

The end surface 52*a* of the lower electrode 52, as shown in FIG. 5(*a*), faces a discharging surface of the ground electrode 40 through an air gap. The distance between the end surface 52*a* of the lower electrode 52 in abutment of the electrode contact with the inner shoulder 14 of the metal shell 10 and a lower edge of the inner shoulder 15 of the metal shell 10 is expressed by "C" which is selected in order to position the ground electrode 40 relative to the metal shell 10.

Next, the upper electrode 51 is, as shown in FIG. 5(*b*), moved downward, as viewed in the drawing, to press the ground electrode 40 against the extension 13. Simultaneously, the electrical current is supplied between the upper and lower electrodes 51 and 52. The pressure to push the upper electrode 51 against the lower electrode 52 is approximately 40 kgf. The current flowing between the upper and lower electrodes 51 and 52 is approximately 2.6 kA.

The current first flows from the upper electrode 51 to the ground electrode 40, to the protrusion 15, to the extension 13, to the body of the metal shell 10, to the inner shoulder 14 of the metal shell 10, and to the lower electrode 52. Specifically, the current is concentrated at the protrusion 15 of the metal shell 10, thus causing the protrusion 15 to melt completely. Afterwards, the extension 13 begins to melt.

While the protrusion 15 and the extension 13 of the metal shell 10 are melting, the ground electrode 40 is pressed by the upper electrode 51 against the metal shell 10, so that the extension 13 partially sinks into and welded to the ground electrode 40. The extension 13 sinks in the ground electrode 40 until the discharging surface of the ground electrode 40 abuts the end surface 52*a* of the lower electrode 52, in other words, until the interval between the discharging surface of the ground electrode 40 and the lower edge of the inner shoulder 14 of the metal shell 10 reaches the distance C.

In the above manner, the ground electrode 40 is welded to the extension 13 of the metal shell 10 under a constant pressure and held at a selected position to the metal shell 10 with a desired degree of parallelization of the discharging surface of the ground electrode 40 to the reference surface 12 of the metal shell 10. The end surface 52*a* of the lower electrode 52 has formed therein a hole (not shown) within which the chip 42 of the ground electrode 40 is placed when the ground electrode 40 is pressed on the extension 13 of the metal shell 10.

In the initial stage of the resistance welding, the current is, as described above, concentrated at the protrusion 15 of the metal shell 10, so that the protrusion 15 melts completely, thereby enhancing the welding of the protrusion 15 to a corresponding area of the ground electrode 40, which increases the strength of joint therebetween. This minimizes a variation in tensile strength, as will be described later in detail.

After the ground electrode 40 is welded to the metal shell 10 in the above manner, the lower electrode 52 is removed from the metal shell 10. Finally, the porcelain insulator 20 within which the center electrode 30 is retained is inserted into the metal shell 10. The end of the metal shell 10 is crimped to hold the porcelain insulator 20 firmly to complete the spark plug 100, as illustrated in FIG. 1.

Results of evaluation of the joint strength of the ground electrode 40 of the spark plug 100 will be described below.

The amount of depth of the extension 13 sinking into the ground electrode 40 in the longitudinal direction of the metal shell 10 is expressed by "A" in FIG. 2. We prepared spark plug samples and measured the tensile strength of the joint between the ground electrode 40 and the metal shell 10 for different values of the sinking depth A and evaluated the strength of the joint.

The sinking depth A was determined in the following manner. The thickness T of the plate body 41 of the ground electrode 40 was first measured. The thickness B of a portion of the plate body 41 abutting the tip end of the extension 13 was measured. In practice, the thickness B was measured at a point N located 1.5 mm inside the outer periphery of the extension 13. The sinking depth A was calculated by the thickness B from the thickness T (i.e., A=T−B).

The specifications of each of the spark plug samples used for the evaluation of the joint strength of the ground electrode 40 are as follows. The metal shell 10 is made of S25C. The plate body 41 of the ground electrode 40 is made of Inconel (i.e., Ni-based alloy). The thickness T of the plate body 41 is 1.6 mm. The width W of the plate body 41, as shown in FIG. 3, is 3.3 mm.

Figure 6:
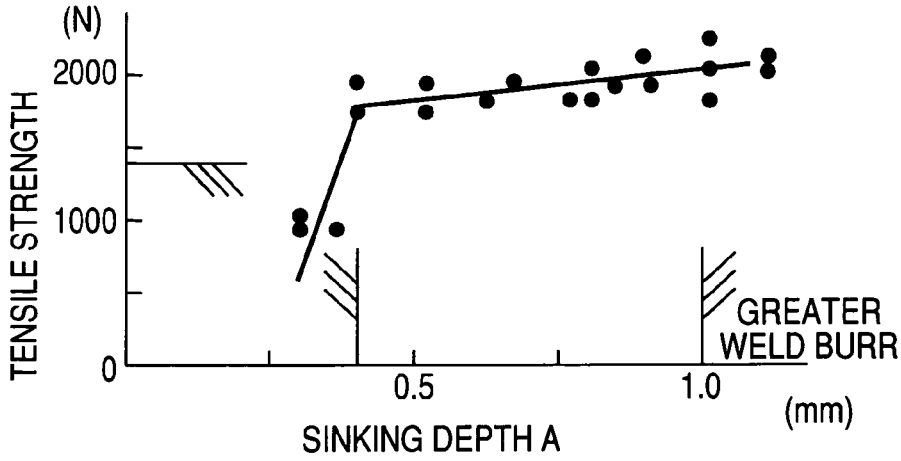
FIG. 6 is a graph which shows results of evaluation of joint strength of a ground electrode of spark plug samples.

FIG. 6 is a graph which shows the results of evaluation of the joint strength of the ground electrode 40 of the spark plug samples. The vertical axis indicates the tensile strength. The horizontal axis indicates the sinking depth A. The graph shows that when the sinking depth A is less than 0.4 mm, the tensile strength is low, resulting in separation of the ground electrode 40 from the extension 13, while when the sinking depth A is 0.4 mm or more, it produces the tensile strength sufficient for practical use.

When the sinking depth A exceeds 1.0 mm, it results in an increased size of weld flashes or burrs, which causes the gap between the weld burrs and the center electrodes 30 to be decreased to induce sparks therebetween. Alternatively, when the sinking depth A is below 1.0 mm, it results in a decreased size of the weld burrs, which eliminates the possibility of sparks produced between the weld burrs and the center electrode 30.

We also prepared another type of spark plug sample in which the plate body 41 of the ground electrode 40 is made of aluminum-containing Inconel, and the width W of the plate body 41 is 4.1 mm and evaluated the joint strength thereof in the same manner as described above. Results of the evaluation showed the same effects as those in the above spark plug samples. Specifically, when the sinking depth A was 0.4 mm or more, it produced the tensile strength sufficient for practical use. When the sinking depth A is less than 1.0 mm, it results in a decreased size of the weld burrs, which eliminates the possibility of sparks produced between the weld burrs and the center electrode 30.

A ratio of the sinking depth A to the thickness T of the plate body 41 of the ground electrode 40 of the spark plug 100 (i.e., A/T) is selected to be within a range of 0.2 to 0.7. A smaller value of the A-T ratio represents that the amount by which the extension 13 is embedded into the ground electrode 40 is smaller. A desired strength of the joint of the ground electrode 40 to the metal shell 10 without sacrificing the mechanical strength of the ground electrode 40 itself is ensured by selecting the value of the A-T ratio within the above range.

Figure 7:
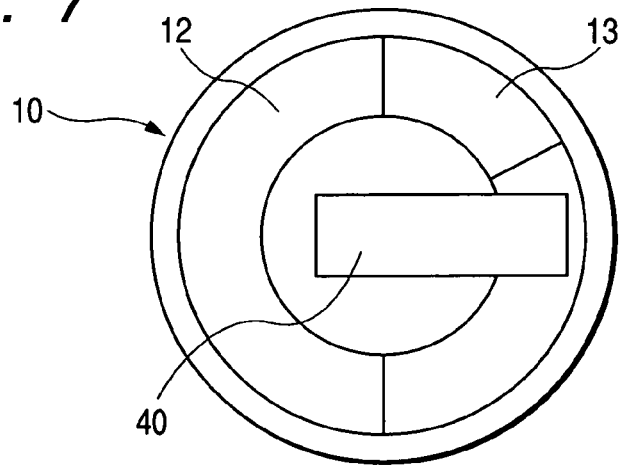
FIG. 7 is a top view which shows a spark plug according to the second embodiment of the invention.

FIG. 7 shows a spark plug according to the second embodiment of the invention which is different from the one of the first embodiment only in the size of the extension 13 of the metal shell 10. Other arrangements are identical, and explanation thereof in detail will be omitted here.

The extension 13 is of a half circle shape and ranges over half a circumference of the end surface of the metal shell 10. If the extension 13 occupies more than one-second of the circumference of the end surface of the metal shell 10, it will be an obstruction to obstruct the spread of the flame kernel within the cylinder of the engine greatly. It is, thus, advisable that the extension 13 occupies one-second or less of the circumference of the end surface of the metal shell 10.

Figure 8:
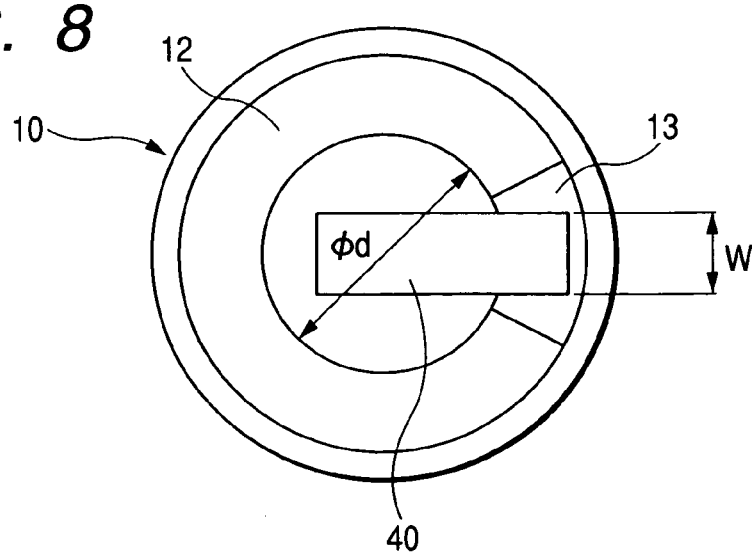
FIG. 8 is a top view which shows a spark plug according to the third embodiment of the invention.

FIG. 8 shows a spark plug according to the third embodiment of the invention which is different from the one of the first embodiment only in the size of the extension 13 of the metal shell 10. Other arrangements are identical, and explanation thereof in detail will be omitted here.

The extension 13 has a length in a circumferential direction of the metal shell 10 which is slightly greater than the width W of the ground electrode 40. For instance, the inner diameter d of the metal shell 10 is 9 mm. The width W of the ground electrode 40 is 3.3 mm. The extension 13 ranges over one-sixth (⅙) of the circumference of the end surface of the metal shell 10. This ensures a sufficient area of the joint between the ground electrode 40 and the metal shell 10 for achieving a desired amount of the heat disappearance or transfer from the ground electrode 40 to the metal shell 10 to assure the heat resistance of the ground electrode 40.

Figure 9:
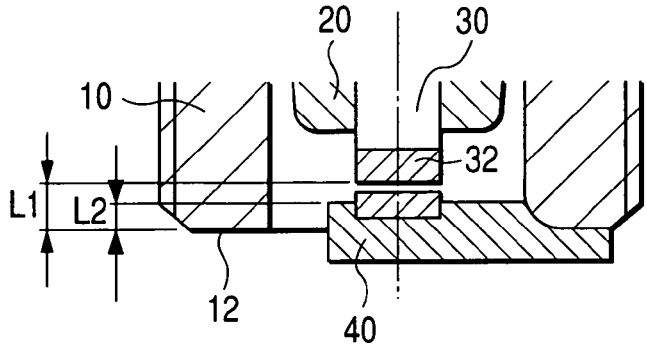
FIG. 9 is a partially sectional view which shows a spark plug according to the fourth embodiment of the invention.

FIG. 9 shows a spark plug according to the fourth embodiment of the invention. The spark plug does not have the extension 13. Specifically, the ground electrode 40 is joined directly to the reference surface 12 of the metal shell 10 by the resistance welding. The tip of the center electrode 30 is disposed inside the metal shell 10. In other words, the tip of the center electrode 30 lies inwardly of the reference surface 12 in the longitudinal direction of the metal shell 10. The discharging surface of the ground electrode 40 which faces the center electrode 30 also lies inside the metal shell 10.

The distance L1 between the tip end of the chip 32 of the center electrode 30 and the reference surface 12 of the metal shell 10 in the longitudinal direction of the metal shell 10 is 1.3 mm. The distance L2 between the interface M of the ground electrode 40 with the metal shell 10 and the reference surface 12 in the longitudinal direction of the metal shell 10 is 0.8 mm. Other arrangements are identical with those in the first embodiment, and explanation thereof in detail will be omitted here.

The structure of the spark plug of this embodiment results in a decreased length of the spark plug disposed inside the combustion chamber of the engine, thus decreasing the temperature of the ground electrode 40 during running of the engine.

Figure 10:
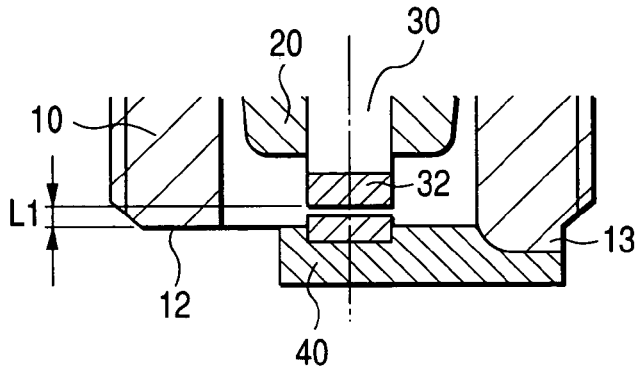
FIG. 10 is a partially sectional view which shows a spark plug according to the fifth embodiment of the invention.

FIG. 10 shows a spark plug according to the fifth embodiment of the invention.

The tip of the center electrode 30 is disposed inside the metal shell 10. In other words, the tip of the center electrode 30 lies inwardly of the reference surface 12 in the longitudinal direction of the metal shell 10. The discharging surface of the ground electrode 40 which faces the center electrode 30 lies flush with the reference surface 12 in a lateral direction of the metal shell 10. The distance L1 between the tip end of the chip 32 of the center electrode 30 and the reference surface 12 in the longitudinal direction of the metal shell 10 is 0.5 mm. Other arrangements are identical with those in the first embodiment, and explanation thereof in detail will be omitted here.

Figure 11:
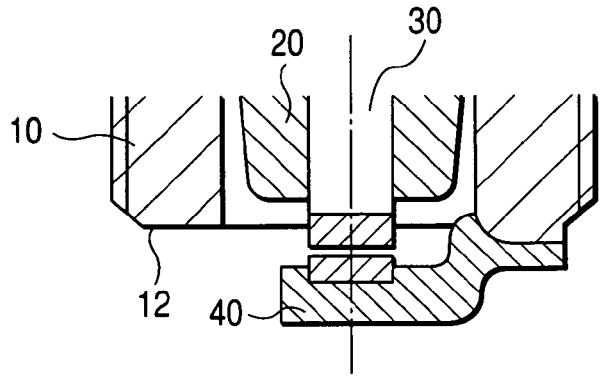
FIG. 11 is a partially sectional view which shows a spark plug according to the sixth embodiment of the invention.

FIG. 11 shows a spark plug according to the sixth embodiment of the invention. The spark plug does not have the extension 13 on the metal shell 10. The ground electrode 40, as clearly shown in the drawing, has a crank-shape and is joined directly to the reference surface 12 of the metal shell 10 by the resistance welding. Other arrangements are identical with those in the first embodiment, and explanation thereof in detail will be omitted here.

Figure 12:
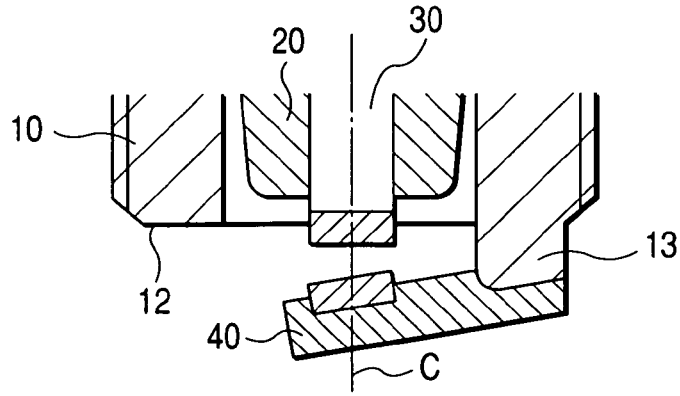
FIG. 12 is a partially sectional view which shows a spark plug according to the seventh embodiment of the invention.

FIG. 12 shows a spark plug according to the seventh embodiment of the invention. The ground electrode 40 extends from the extension 13 at a given angle to the longitudinal center line C of the metal shell 10 other than 90°. Other arrangements are identical with those in the first embodiment, and explanation thereof in detail will be omitted here.

Figure 13:
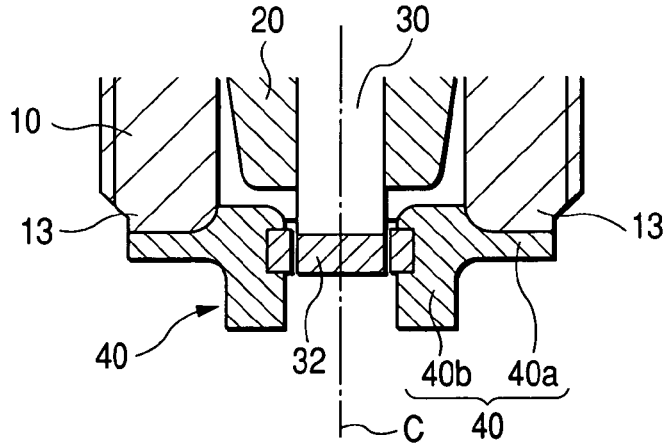
FIG. 13 is a partially sectional view which shows a spark plug according to the eighth embodiment of the invention.
Figure 14:
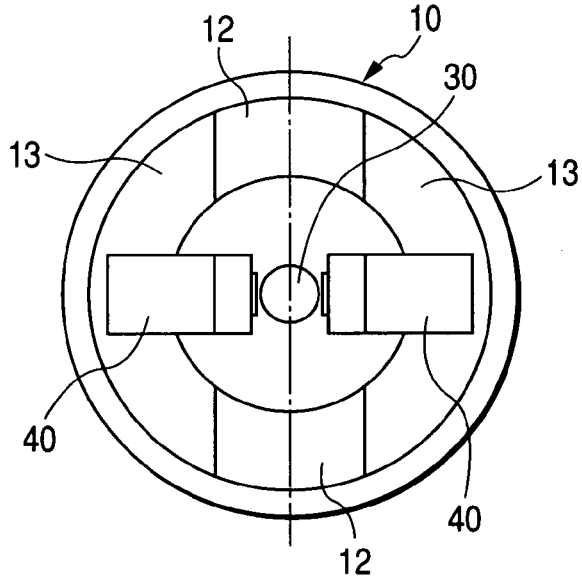
FIG. 14 is a top view of FIG. 13.

FIGS. 13 and 14 show a spark plug according to the eighth embodiment of the invention. The spark plug is a two-ground electrode plug equipped with two L-shaped ground electrodes 40. The metal shell 10 has two arc-shaped extensions 13. Each of the L-shaped ground electrodes 40 is joined to one of the extensions 13 by the resistance welding. Specifically, each of the ground electrodes 40 is made up of a horizontal strip 40*a* and a vertical strip 40*b*. The horizontal strip 40*a* extends perpendicular to the longitudinal center line C of the metal shell 10 and connects with the extension 13. The vertical strap 40*b* extends from the horizontal strip 40*a* in parallel to the longitudinal center line C and has a discharging surface facing the chip 32 of the center electrode 30. Other arrangements are identical with those in the first embodiment, and explanation thereof in detail will be omitted here.

Figure 15:
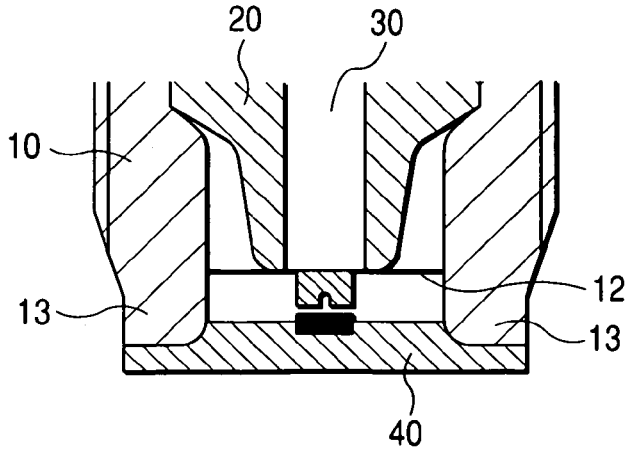
FIG. 15 is a partially sectional view which shows a spark plug according to the ninth embodiment of the invention.
Figure 16:
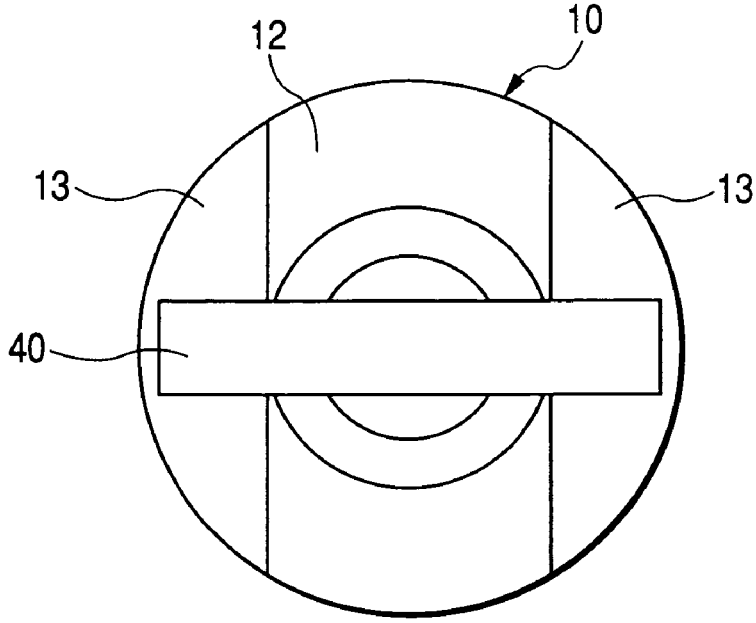
FIG. 16 is a top view of FIG. 15.

FIGS. 15 and 16 show a spark plug according to the ninth embodiment of the invention. The spark plug has two extensions 13 formed on the metal shell 10 and the ground electrode 40 joined at ends thereof to the extensions 13 by the resistance welding. Other arrangements are identical with those in the first embodiment, and explanation thereof in detail will be omitted here.

Figure 17:
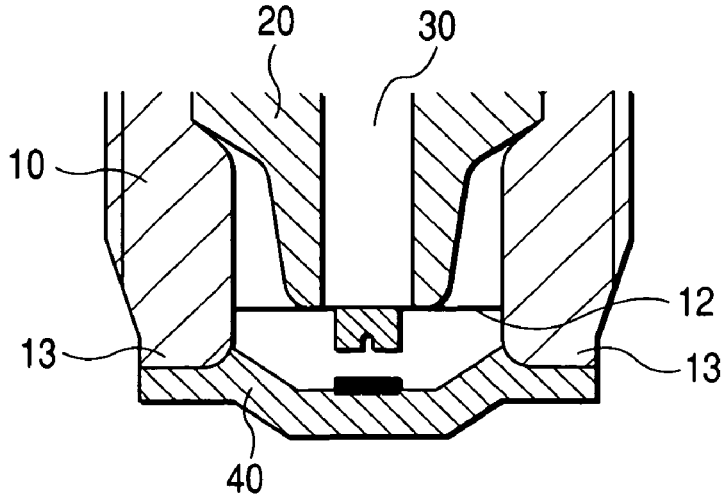
FIG. 17 is a partially sectional view which shows a spark plug according to the tenth embodiment of the invention.

FIG. 17 shows a spark plug according to the tenth embodiment of the invention. The spark plug has two extensions 13 formed on the metal shell 10 and the ground electrode 40 with a central bulge. The ground electrode 40 is jointed at ends thereof to the extensions 13 by the resistance welding. Other arrangements are identical with those in the first embodiment, and explanation thereof in detail will be omitted here.

The ground electrode(s) 40, as used in the above embodiments, may be made of a material containing 50 Wt % or more of Ni or 50 Wt % or more of Fe.

While the spark plug 100 of the first embodiment has the protrusion 15, as illustrated in FIGS. 4(*a*) and 4(*b*), in order to ensure the stability of joint strength of the ground electrode 40, it may be used in other embodiments. Alternatively, the spark plug 100 of the first embodiment may not have the protrusion 15.

Figure 18A:
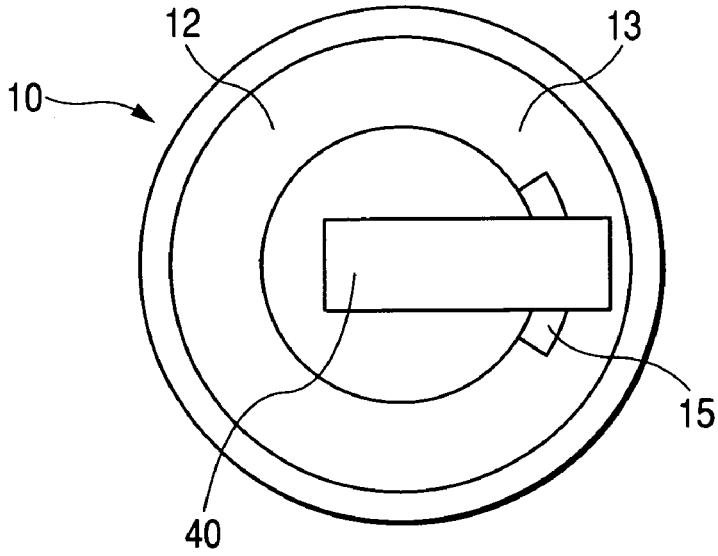
FIG. 18(*a*) is a top view which shows a modified form of a spark plug in which a protrusion is formed directly on an end surface of a metal shell.
Figure 18B:
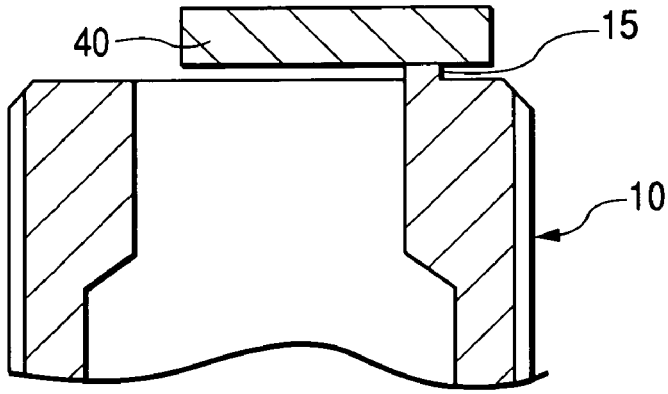

In a case where the metal shell 10, like the one in the fourth embodiment, does not have the extension 13, the protrusion 15 is preferably formed on at least a portion of the metal shell 10 to which the ground electrode 40 is to be welded. FIGS. 18(*a*) and 18(*b*) show an example wherein the protrusion 15 is formed directly on the reference surface 12 of the metal shell 10. Specifically, the protrusion 15 extends on a portion of an inner edge of the reference surface 12 to which the ground electrode 40 is to be welded. Other arrangements are identical with those in the first embodiment.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A spark plug comprising:

a hollow cylindrical metal shell;

a center electrode retained in said metal shell to be insulated from said metal shell; and a ground electrode having a portion facing a tip of said center electrode through a spark gap, said ground electrode being joined to said metal shell through a weld, so that a portion of said metal shell is sunk into and embedded in said ground electrode, the weld extending from an end surface of said metal shell to an inner peripheral surface of said metal shell, wherein the weld is formed by melting said ground electrode and the end surface of said metal shell and sinking a portion of the end surface of said metal shell into said ground electrode in a longitudinal direction of said metal shell, and wherein a ratio of a sinking depth of said metal shell in said ground electrode to a thickness of a major body of said ground electrode is within a range of 0.2 to 0.7, and wherein said metal shell has a rounded corner formed between the inner peripheral surface and the end surface of said metal shell, said rounded corner being joined to said ground electrode through the weld, and wherein the inner peripheral surface of said metal shell faces said center electrode.

2. A spark plug as set forth in claim 1, wherein said ground electrode is jointed to said metal shell by resistance welding.

3. A spark plug as set forth in claim 1, wherein said metal shell has an extension extending from the end surface of said metal shell in a longitudinal direction of said metal shell, and wherein said ground electrode is welded to the extension.

4. A spark plug as set forth in claim 1, wherein said ground electrode is made of a plate member which extends straight from the weld to said metal shell toward a longitudinal center line of said metal shell.

5. A spark plug as set forth in claim 3, wherein the tip of said center electrode projects outside the end surface of said metal shell in a longitudinal direction of said metal shell, and wherein said extension extends outside the tip of said center electrode in the longitudinal direction of said metal shell.

6. A spark plug as set forth in claim 1, wherein the weld is formed by melting said ground electrode and the end surface of said metal shell and sinking a portion of the end surface of said metal shell into said ground electrode in a longitudinal direction of said metal shell, and wherein a sinking depth of said metal shell in said ground electrode is 0.4 mm or more.

7. A spark plug as set forth in claim 1, wherein the weld is formed by melting said ground electrode and the end surface of said metal shell and sinking a portion of the end surface of said metal shell into said ground electrode in a longitudinal direction of said metal shell, and wherein a sinking depth of said metal shell in said ground electrode is 1.0 mm or less.

8. A spark plug as set forth in claim 3, wherein said extension has a length which extends in a circumferential direction of the end surface of said metal shell and is greater than a width of said ground electrode.

9. A spark plug as set forth in claim 3, wherein said extension has a length which extends over one-second or less of a circumference of the end surface of said metal shell.

10. A spark plug as set forth in claim 1, wherein said ground electrode has s composition containing 50 Wt % or more of one of Ni and Fe.

11. A spark plug as set forth in claim 1, wherein said metal shell includes first and second longitudinal extensions, each of which are joined to said ground electrode through a said weld, so that a portion of each said extension of said metal shell is sunk into and embedded in said ground electrode, each weld extends from an end surface of the respective extension of said metal shell to a respective inner surface of said extension of said metal shell, and each said extension of said metal shell has a rounded corner formed between the inner peripheral surface and the end surface thereof.

* * * * *